US010309360B2

(12) United States Patent
Falaschi et al.

(10) Patent No.: US 10,309,360 B2
(45) Date of Patent: Jun. 4, 2019

(54) VALVE ASSEMBLY FOR AN INJECTION VALVE AND INJECTION VALVE

(71) Applicant: CONTINENTAL AUTOMOTIVE GMBH, Hannover (DE)

(72) Inventors: Filippo Falaschi, Fauglia (IT); Christoph Hamann, Thalmassing (DE); Luigi Marchi, Pisa (IT)

(73) Assignee: CPT Group GmbH, Hannover (DE)

( * ) Notice: Subject to any disclaimer, the term of this patent is extended or adjusted under 35 U.S.C. 154(b) by 134 days.

(21) Appl. No.: 15/630,403

(22) Filed: Jun. 22, 2017

(65) Prior Publication Data

US 2017/0370340 A1 Dec. 28, 2017

(30) Foreign Application Priority Data

Jun. 24, 2016 (EP) ..... 16176098

(51) Int. Cl.
*F02M 51/06* (2006.01)
*F02M 61/20* (2006.01)

(52) U.S. Cl.
CPC ..... *F02M 61/20* (2013.01); *F02M 51/066* (2013.01); *F02M 51/0625* (2013.01); *F02M 2200/50* (2013.01)

(58) Field of Classification Search
CPC ..... F02M 51/061; F02M 51/0625; F02M 51/0635; F02M 51/0653; F02M 51/066; F02M 61/20; F02M 2200/50
USPC ..... 239/585.1–585.5
See application file for complete search history.

(56) References Cited

U.S. PATENT DOCUMENTS 5,044,561 A 9/1991 Holzgrefe
6,510,841 B1 * 1/2003 Stier ..... F02M 51/0625 123/472
6,824,084 B2 * 11/2004 Maier ..... F02M 51/0671 239/533.11
2009/0159729 A1 * 6/2009 Yoshimaru ..... F02M 51/0682 239/585.1
2011/0057059 A1 * 3/2011 Yamamoto ..... F02M 51/0675 239/584

(Continued)

FOREIGN PATENT DOCUMENTS

EP 2333297 A1 6/2011
EP 2789844 A1 10/2014

(Continued)

OTHER PUBLICATIONS

European Search Report dated Sep. 21, 2016, for counterpart European Patent Application No. 16176098.8.

(Continued)

*Primary Examiner* — Darren W Gorman

(57) ABSTRACT

A valve assembly for an injection valve is disclosed, including a valve body with a cavity, a valve needle axially moveable in the cavity, the valve needle being fixedly connected to a retaining element which extends in radial direction and is arranged in an axial region of the valve needle facing away from the fluid outlet portion, and an armature being able to slide on the valve needle and acting on the needle by way of the retaining element. A conical spring is arranged between the retaining element and a top side of the armature facing the retaining element, biasing the armature away from the retaining element.

13 Claims, 2 Drawing Sheets

(56) References Cited

U.S. PATENT DOCUMENTS

| | | | | |
|---|---|---|---|---|
| 2012/0067982 | A1* | 3/2012 | Perry | F02M 51/0685 239/585.3 |
| 2013/0214066 | A1* | 8/2013 | Suzuki | F02M 51/0685 239/585.5 |
| 2016/0076499 | A1* | 3/2016 | Matsukawa | F02M 51/0685 239/585.5 |
| 2017/0145974 | A1* | 5/2017 | Yasuda | F02M 51/0685 |

FOREIGN PATENT DOCUMENTS

| | | | |
|---|---|---|---|
| EP | 2535552 | B1 | 2/2015 |
| EP | 2985445 | A1 | 2/2016 |
| JP | 2013104340 | A1 | 5/2013 |
| JP | 2014015857 | A1 | 1/2014 |
| JP | 2015519514 | A | 7/2015 |
| KR | 20-1998-0054461 | U | 10/1998 |

OTHER PUBLICATIONS

Korean Office Action dated Apr. 19, 2018 for corresponding Korean Patent Application No. 10-2017-0076836.
Korean Office Action dated Nov. 10, 2018 for corresponding Korean Patent Application No. 10-2017-0076836.
Korean Notice of Allowance dated Feb. 13, 2019 for corresponding Korean Patent Application No. 10-2017-0076836.

* cited by examiner

VALVE ASSEMBLY FOR AN INJECTION VALVE AND INJECTION VALVE

CROSS REFERENCE TO RELATED APPLICATION

This application claims priority from European Application 16176098.8, filed Jun. 24, 2016, which is hereby incorporated by reference herein.

FIELD OF INVENTION

The present disclosure relates to a valve assembly for an injection valve and to an injection valve, e.g., a fuel injection valve of a vehicle and particularly a solenoid injection valve.

BACKGROUND

Such injection valves must be able to dose fluids even in the case of high fuel pressure. One design to ensure this is the "free-lift" design. According to this design, the armature of the electro-magnetic actuator unit travels about a "pre-stroke gap" before it engages the needle to open the injector. Thus, kinetic energy is accumulated before the actual opening.

The "free-lift"-concept uses a so called free-lift spring that biases the armature away from an upper retaining element, which is fixed to the valve needle. When the actuator unit is energized, the armature travels against the load of this spring before engaging the upper retaining element for moving the valve needle. Generally, the further the armature travels before engaging the valve needle, the more kinetic energy it will have accumulated. Therefore, in order to manage high fuel pressures, a large spring travel is advantageous.

On the other hand, a compact injector is advantageous as space is tight in automotive applications. Therefore, one solution is to arrange a free-lift spring in a recess in the armature. This, however, reduces the guidance length of the valve needle and can cause functional problems and wear.

SUMMARY

It is an object of the present disclosure to provide a valve assembly for an injection valve that overcomes the above mentioned difficulties and which provides a stable performance with a high maximum pressure.

According to one aspect, a valve assembly for an injection valve is provided, comprising a valve body with a central longitudinal axis comprising a cavity with a fluid inlet portion and a fluid outlet portion. The valve assembly further comprises a valve needle axially moveable in the cavity. In particular, the valve needle is displaceable in reciprocating fashion relative to the valve body. The valve needle is operable to prevent a fluid flow through the fluid outlet portion in a closing position and to release the fluid flow through the fluid outlet portion in further positions.

The valve needle is fixedly connected to a retaining element, which extends in radial direction from the needle and is arranged in an axial region of the valve needle facing away from the fluid outlet portion. In the present context, this includes embodiments in which the retaining element is in one piece with the valve needle and projects in radial outward direction from a shaft of the valve needle.

The valve assembly further comprises an armature for an electromagnetic actuator unit. The armature is axially movable in the cavity; specifically the armature is axially displaceable relative to the valve body in reciprocating fashion.

The armature comprises a central axial opening through which the valve needle extends. In this way, the armature may be joined to the valve needle by form-fit. The form-fit joint between the armature and the valve needle limits the movement of the armature only in radial direction. The armature is able to slide on the valve needle, i.e. the armature is axially displaceable in reciprocating fashion also relative to the valve needle.

The armature acts on the needle by way of the upper retaining element. In particular, the valve needle is operable to engage in form-fit connection with the retaining element for axially displacing the valve needle away from the closing position.

A conical spring is arranged around the central longitudinal axis between the retaining element and a top side of the armature facing the upper retaining element, biasing the armature away from the upper retaining element.

This valve assembly has the advantage that almost the whole length of the conical spring can be used to full capacity, because windings of a conical spring can coil into each other when the spring is compressed, with the result that in the case of maximum compression, the height of the conical spring may only be about, e.g., two times the diameter of the spring wire. Thus, a large spring travel can be achieved with a conical spring in spite of limited available space. Hence, a particularly compact free-lift injector suitable for dosing high pressure fuel is created.

In one embodiment, the valve assembly comprises a lower retaining element, which is fixed to the valve needle on a side of the armature remote from the retaining element. Therefore, the retaining element is also denoted as an upper retaining element in the following. In an expedient development, the conical spring biases the armature in contact with the lower retaining element.

In one embodiment, the armature has a flat surface which is operable to engage in form fit connection with the upper retaining element, in particular for axially displacing the valve needle away from the closing position. In one development, the flat surface also represents a seat for the conical spring. The flat surface preferably extends perpendicular to the longitudinal axis. In this way, a simple geometry of the armature and/or easy assembly of the conical spring with the armature is/are achievable.

In one embodiment, the upper retaining element comprises a sleeve portion which axially overlaps the conical spring and a collar portion projecting in radially outward direction beyond the sleeve portion and representing a seat for the conical spring. Preferably, the armature engages in form-fit connection with the sleeve portion for acting on the valve needle to move the valve needle axially. With advantage, the retaining element has a simple shape and at the same time reliably provides all necessary functions.

According to one embodiment, the diameter of the windings of the conical spring increases at least by 2d per turn, wherein d is the diameter of spring wire. This embodiment has the advantage that each winding can coil into the previous one, so that the fully compressed spring is only slightly higher than the diameter d of one spring wire, i.e., about two times the diameter d.

According to one embodiment, the diameter of the windings of the conical spring is minimal at a first end of the spring facing the upper retaining element and maximal at a second end facing the armature and increases in the direction towards the armature. The diameter of the windings may increase uniformly in between.

According to this embodiment, the spring is oriented so that the small-diameter windings are facing upwards towards the upper retaining element. Thus, individual windings are prevented from being pushed into the gap between the upper retaining element and the armature, which could result in blocking the movement of the armature.

According to one embodiment, the armature comprises a plurality of through holes forming fluid passages between the fluid inlet portion and the fluid outlet portion, wherein first ends of the through holes are exposed on the top side of the armature outside the area covered by the conical spring.

The area covered by the conical spring is understood to be that part of the top side of the armature, onto which the windings of the spring coil when the spring is compressed, i.e., the inner annular part of the armature close to the needle up to the radius of the conical spring. In other words, the through holes are offset in radial outward direction with respect to the conical spring, in one embodiment at least in a plane comprising the above-mentioned flat surface of the armature.

According to this embodiment, the through holes end outside this area, so that fluid flow through the through holes is not prevented by the conical spring.

According to one aspect of the invention, an injection valve with the described valve assembly is provided, further comprising an electromagnetic actuator unit. The electromagnetic actuator unit may expediently comprise the armature. The electromagnetic actuator unit particularly comprises a coil which may be energized to induce a magnetic field which acts on the armature of the valve assembly for moving the armature in axial direction towards the upper retaining element. The injection valve may in particular be a fuel injection valve of a vehicle.

Further advantages, advantageous embodiments and developments of the valve assembly for an injection valve, the fluid injection valve and the method for manufacturing a fluid injection valve will become apparent from the exemplary embodiments which are described below in association with the schematic figures.

DETAILED DESCRIPTION

Figure 1:
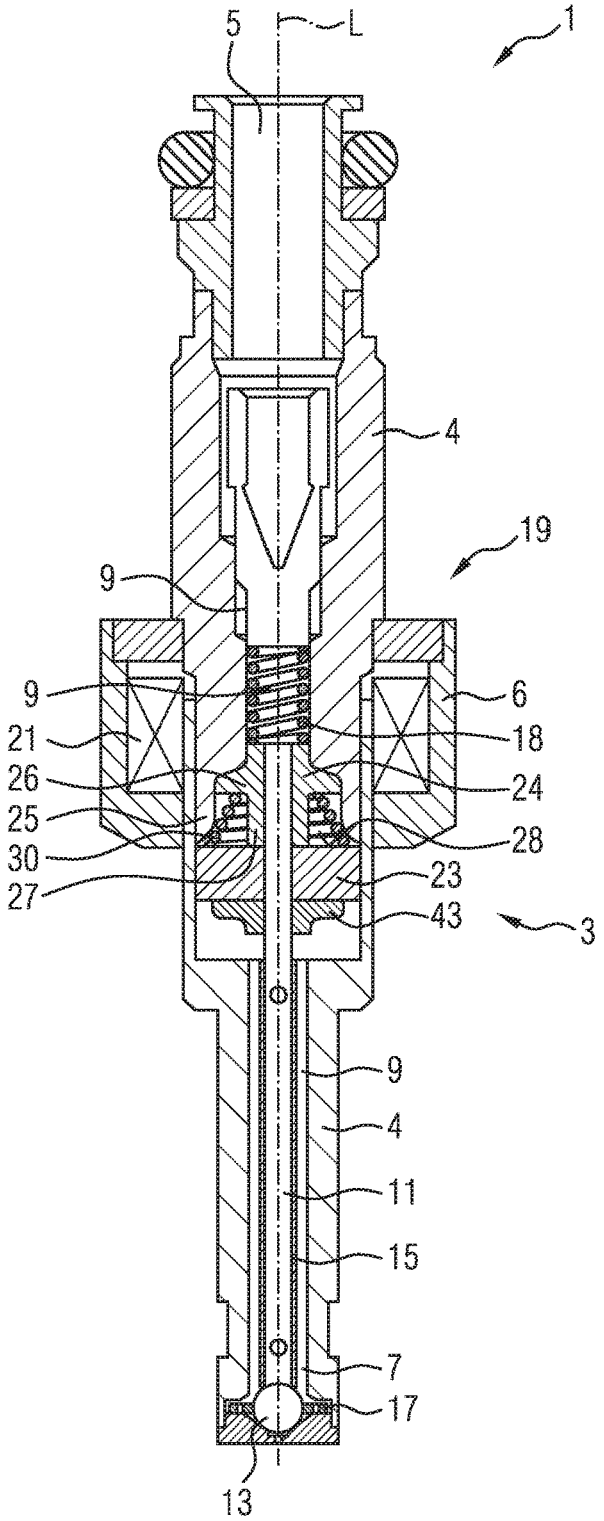
FIG. 1 shows a sectional view of an injection valve with a valve assembly according to one embodiment of the invention and FIG. 2 shows a detail of FIG. 1.

FIG. 1 shows an injection valve 1 that is in particular suitable for dosing fuel to an internal combustion engine. The injection valve 1 comprises in particular a valve assembly 3. The valve assembly 3 comprises a valve body 4 with a central longitudinal axis L. A housing 6 is partially arranged around the valve body 4.

The valve body 4 comprises a cavity 9. The cavity 9 has a fluid outlet portion 7. The fluid outlet portion 7 communicates with a fluid inlet portion 5 which is provided in the valve body 4. The fluid inlet portion 5 and the fluid outlet portion 7 are in particular positioned at opposite axial ends of the valve body 4. The cavity 9 takes in a valve needle 11. The valve needle 11 comprises a needle shaft 15 and a sealing ball 13 welded to the tip of the needle shaft 15.

In a closing position of the valve needle 11, valve needle 11 sealingly rests on a seat plate 17 having at least one injection nozzle. A preloaded calibration spring 18 exerts a force on the needle 11 in axial direction towards the closing position. The fluid outlet portion 7 is arranged near the seat plate 17.

In the closing position of the valve needle 11, a fluid flow through the at least one injection nozzle is prevented. The injection nozzle may be, for example, an injection hole. However, the injection nozzle may also be of some other type suitable for dosing fluid.

The valve assembly 3 is provided with an electro-magnetic actuator unit 19. The electro-magnetic actuator unit 19 comprises a coil 21, which is preferably arranged inside the housing 6. Furthermore, the electro-magnetic actuator unit 19 comprises an armature 23. The housing 6, parts of the valve body 4 and the armature 23 form an electromagnetic circuit. The actuator unit 19 further comprises a pole piece 25.

The armature 23 is axially movable in the cavity 9 and fixed to the valve needle 11 by form fit, this joint preventing movement of the armature 23 relative to the valve needle 11 in radial direction. The needle 11 extends through a central axial opening in the armature 23. The armature 23 is axially movable relative to the valve needle 11, i.e. the armature 23 may slide on the needle 11.

At an axial end of the valve needle 11, the valve needle 11 comprises an upper retaining element 24. The upper retaining element 24 has a sleeve portion—in the following denoted as base portion 27—extending circumferentially around the axial end of the valve needle 11 and further comprises a collar portion 26 extending in radial direction away from the valve needle 11 so that it projects in radial outward direction beyond the base potion 27. The upper retaining element 24 is an integrally formed, one-pieced part. In this embodiment, the upper retaining element 24 is a separate piece but fixedly connected to the axial end of the valve needle 11. In further embodiments, the upper retaining element 24 may be formed in one piece with the valve needle 11.

Between the upper retaining element 24 and a top side 28 of the armature 23 facing the upper retaining element 24, a conical spring 30 is arranged around the central longitudinal axis L and around the base portion 27 of the upper retaining element 24, biasing the armature 23 away from the upper retaining element 24.

The conical spring 30 rests on a flat surface of the armature 23 on the top side 28 of the armature 23 with first end of the conical spring 30, which has a large diameter. Conical spring 30 rests against the collar 26 of the upper retaining element 24 with its second end, which has a smaller diameter.

The conical spring 30 comprises a number of windings, the diameter of which increases by at least 2d per turn, where d is the diameter of the spring wire. Thus, the spring 30 may be compressed tightly, taking up comparatively little space. Consequently, the spring travel of the conical spring 30 is comparatively large.

The conical spring 30 enables a transmission of forces between the armature 23 and the upper retaining element 24. The dampening effect of the spring 30 enables that the wearing effects on the armature 23 and/or on the valve needle 11 may be kept small during the opening or closing process of the valve needle 11.

In the closing position of the valve 1, there is a gap between the upper retaining element 24 and the armature 23, also called the free-lift gap. When the coil 21 is energized, the armature 23 experiences a magnetic force and slides upwards towards the pole piece 25, moving in an axial direction away from the fluid outlet portion 7, thereby compressing the conical spring 30.

Only after having travelled the gap and after having taken up kinetic energy, the flat surface of the armature 23 on which the conical spring 30 is seated hits the base portion 27 of the upper retaining element 24 and takes the valve needle 11 with it via the form-fit connection with the upper retaining element 24 that is established in this way. Consequently, the valve needle 11 moves in an axial direction out of the closing position of the valve 1. When the armature 23 starts to travel upwards, a gap is formed between the armature 23 and a disc-shaped element 43 fixedly connected to the needle 11 on the side of the armature 23 remote from the upper retaining element 24. The disc-shaped element 43 represents a lower retaining element which limits axial displacement of the armature 23 relative to the valve needle 11 in direction away from the upper retaining element 24.

When the coil 21 is de-energized, the calibration spring 18 is able to force the valve needle 11 to move in an axial direction into its closing position. At the end of the closing transient, when the valve needle 11 hits the seat plate 17, the armature 23 detaches from the upper retaining element 24 and travels downwards towards the disc-shaped element 43, closing the gap between armature 23 and disc-shaped element 43.

Figure 2:
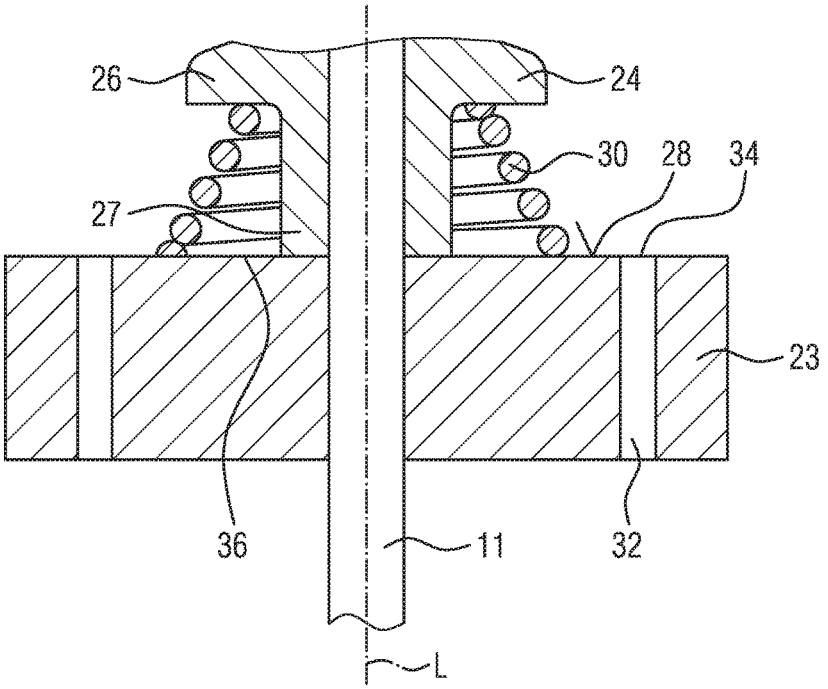

FIG. 2 shows a detail of the injection valve 1. The armature 23 comprises a number of through holes 32, which form fluid passages between the fluid inlet portion 5 and the fluid outlet portion 7. First ends 34 of the through holes 32 are exposed on the top side 28 of the armature 23 outside the area 36 covered by the conical spring 30. The area 36 covered by the conical spring 30 is the inner area of the top side 28, where windings of the conical spring 30 are arranged. Hence, the area 36 is annular, extends around the base portion 27 of the upper retaining element 24 and has the outer diameter of the largest windings of the conical spring 30.

Embodiments have been described herein in an illustrative manner, and it is to be understood that the terminology which has been used is intended to be in the nature of words of description rather than of limitation. Obviously, many modifications and variations of the invention are possible in light of the above teachings. The description above is merely exemplary in nature and, thus, variations may be made thereto without departing from the spirit and scope of the invention as defined in the appended claims.

The invention claimed is:

1. A valve assembly for an injection valve, comprising:

a valve body with a central longitudinal axis comprising a cavity with a fluid inlet portion and a fluid outlet portion, a retaining element, a valve needle axially moveable in the cavity, the valve needle preventing a fluid flow through the fluid outlet portion in a closing position and releasing the fluid flow through the fluid outlet portion in further positions, the valve needle being fixedly connected to the retaining element which extends in a radial direction and is arranged in an axial region of the valve needle facing away from the fluid outlet portion, an armature for an electromagnetic actuator unit axially movable in the cavity, the armature comprising a central axial opening through which the valve needle extends, the armature being able to slide on the valve needle and acting on the needle by way of the retaining element, and a conical spring arranged around the central longitudinal axis between the retaining element and a top side of the armature facing the retaining element, biasing the armature away from the retaining element.

2. The valve assembly according to claim 1, wherein the armature has a flat surface which is operable to engage in form fit connection with the retaining element and which represents a seat for the conical spring.

3. The valve assembly according to claim 1, wherein the retaining element comprises a sleeve portion which axially overlaps the conical spring and a collar portion projecting in a radially outward direction beyond the sleeve portion and representing a seat for the conical spring.

4. The valve assembly according to claim 1, wherein the conical spring includes a plurality of spring wire windings, a diameter of the windings of the conical spring increases at least by 2d per turn, wherein d is the diameter of the spring wire.

5. The valve assembly according to claim 1, wherein the conical spring includes a plurality of windings, the diameter of the windings of the conical spring is minimal at a first end of the spring facing the retaining element and maximal at a second end facing the armature and increases in the direction towards the armature.

6. The valve assembly according to claim 1, wherein the armature comprises a number of through holes forming fluid passages between the fluid inlet portion and the fluid outlet portion, wherein first ends of the through holes are disposed on the top side of the armature radially outside of an area covered by the conical spring.

7. The valve assembly according to claim 1, wherein the valve assembly is part of and is disposed in an injection valve, the injection valve further comprising an electromagnetic actuator unit operatively coupled to the valve assembly, the electromagnetic actuator unit including the armature.

8. An injection valve, comprising:

an electromagnetic actuator unit including an armature; and a valve assembly operably coupled to the actuator unit, comprising:

a valve body with a central longitudinal axis comprising a cavity with a fluid inlet portion and a fluid outlet portion, a retaining element disposed in the cavity, a valve needle axially moveable in the cavity, the valve needle preventing a fluid flow through the fluid outlet portion in a closing position and releasing the fluid flow through the fluid outlet portion in further positions, the valve needle being fixedly connected to the retaining element which extends in a radial direction and is arranged in an axial region of the valve needle facing away from the fluid outlet portion, and a conical spring arranged around the central longitudinal axis between the retaining element and a top side of the armature facing the retaining element, biasing the armature away from the retaining element, wherein the armature of the electromagnetic actuator unit is axially movable in the cavity, the armature comprising a central axial opening through which the valve needle extends, the armature being able to slide on the valve needle and acting on the needle by way of the retaining element.

9. The injection valve of claim 8, wherein the armature has a flat surface which is operable to engage in form fit connection with the retaining element and which represents a seat for the conical spring.

10. The injection valve of claim 8, wherein the retaining element comprises a sleeve portion which axially overlaps the conical spring and a collar portion projecting in a radially outward direction beyond the sleeve portion and representing a seat for the conical spring.

11. The injection valve of claim 8, wherein the conical spring includes a plurality of spring wire windings, a diameter of the windings of the conical spring increases at least by 2d per turn, where d is the diameter of the spring wire.

12. The injection valve of claim 8, wherein the conical spring includes a plurality of windings, the diameter of the windings of the conical spring is at a smallest diameter at a first end of the spring facing the retaining element and at a largest diameter at a second end facing the armature and increases in the direction towards the armature.

13. The injection valve of claim 8, wherein the armature comprises a number of through holes forming fluid passages between the fluid inlet portion and the fluid outlet portion, wherein first ends of the through holes are located on the top side of the armature radially outside an area covered by the conical spring.

* * * * *